US007693711B2

(12) United States Patent
Murashima

(10) Patent No.: US 7,693,711 B2
(45) **Date of Patent: *Apr. 6, 2010**

(54) SPEECH SIGNAL DECODING METHOD AND APPARATUS

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 35 days.

This patent is subject to a terminal disclaimer.

(21) Appl. No.: 12/230,290

(22) Filed: Aug. 27, 2008

(65) Prior Publication Data

US 2009/0012780 A1 Jan. 8, 2009

Related U.S. Application Data

(63) Continuation of application No. 11/335,739, filed on Jan. 20, 2006, now Pat. No. 7,426,465, which is a continuation of application No. 09/627,421, filed on Jul. 27, 2000, now Pat. No. 7,050,968.

(30) Foreign Application Priority Data

Jul. 28, 1999 (JP) ..... 11-214292

(51) Int. Cl.
*G10L 19/14* (2006.01)
*G10L 21/00* (2006.01)

(52) U.S. Cl. ..... 704/225; 704/219

(58) Field of Classification Search ..... 704/205–210, 704/219–225

See application file for complete search history.

(56) References Cited

U.S. PATENT DOCUMENTS 5,267,317 A 11/1993 Kleign
5,752,223 A 5/1998 Aoyagi et al.
5,848,387 A 12/1998 Nishiguchi et al.
5,946,651 A 8/1999 Jarvinen et al.

(Continued)

FOREIGN PATENT DOCUMENTS

CA 2112145 6/1994

(Continued)

OTHER PUBLICATIONS

M. R. Schroeder, "Code-exited linear prediction: High-quality speech at very low bit rates" *Proc. Of IEE Int. Conf. On Acoust.*, Speech and Signal Processing, pp. 937-940 (1985).

(Continued)

*Primary Examiner*—David R Hudspeth
*Assistant Examiner*—Samuel G Neway
(74) *Attorney, Agent, or Firm*—Foley & Lardner LLP

(57) ABSTRACT

In a speech signal decoding method, information containing at least a sound source signal, gain, and filter coefficients is decoded from a received bit stream. Voiced speech and unvoiced speech of a speech signal are identified using the decoded information. Smoothing processing based on the decoded information is performed for at least either one of the decoded gain and decoded filter coefficients in the unvoiced speech. The speech signal is decoded by driving a filter having the decoded filter coefficients by an excitation signal obtained by multiplying the decoded sound source signal by the decoded gain using the result of the smoothing processing. A speech signal decoding apparatus is also disclosed.

12 Claims, 5 Drawing Sheets

U.S. PATENT DOCUMENTS

| | | | |
|---|---|---|---|
| 6,088,670 | A | 7/2000 | Takada |
| 6,098,036 | A | 8/2000 | Zinser, Jr. et al. |
| 6,122,611 | A | 9/2000 | Su et al. |
| 6,202,046 | B1 | 3/2001 | Oshikiri et al. |
| 6,377,915 | B1 | 4/2002 | Sasaki |
| 7,050,968 | B1 | 5/2006 | Murashima |

FOREIGN PATENT DOCUMENTS

| | | | |
|---|---|---|---|
| EP | 0731348 | A2 | 9/1996 |
| JP | 9-244695 | A | 9/1997 |
| JP | 10-083200 | A | 3/1998 |
| JP | 10-124097 | A | 5/1998 |
| JP | 10-222194 | A | 8/1998 |
| JP | 11-133997 | A | 5/1999 |

OTHER PUBLICATIONS

"Digital Cellular Telecommunication System; Adaptive Multi-Rate Speech Transcoding" *ETSI Technical Report* GSM 06-90 version 2.0.0, pp. 3-66, Jan. 1999.

K. Ozawa et al, "M-LCELP Speech Coding at 4 kb/s with Multi-Mode and Multi-Codebook", *IEICE Trans. On Commun.*, vol. E77-B, No. 9, pp. 1114-1121, (Sep. 1994).

L. R. Rabiner et al, "Digital processing of Speech Signals", Prentice-Hall, pp. 396-419, (1978).

Taniguchi et al., "Enhancement of VSELP Coded Speech Under Background Noise," 1995 IEEE Workshop on Speech Coding for Telecommunications, Sep. 20, 1995, pp. 67-68.

Ekudden et al., "The Adaptive Multi-rate Speech Coder," Speech Coding Proceedings, 1999 IEEE Workshop on Porvoo, Finland Jun. 2-23, 1999, Piscataway, NJ, USA, IEEE, US, Jun. 20, 1999, pp. 117-119.

SPEECH SIGNAL DECODING METHOD AND APPARATUS

CROSS-REFERENCE TO RELATED PATENT APPLICATIONS

This application is a continuation of application Ser. No. 11/335,739, filed Jan. 20, 2006, now pending, which is a continuation of application Ser. No. 09/627,421, filed Jul. 27, 2000, now U.S. Pat. No. 7,050,968, issued May 23, 2006, and based on Japanese Patent Application No. 11-214292, filed Jul. 28, 1999, by Atsushi Murashima. This application claims only subject matter disclosed in the parent applications and therefore presents no new matter.

BACKGROUND OF THE INVENTION

The present invention relates to encoding and decoding apparatuses for transmitting a speech signal at a low bit rate and, more particularly, to a speech signal decoding method and apparatus for improving the quality of unvoiced speech.

As a popular method of encoding a speech signal at low and middle bit rates with high efficiency, a speech signal is divided into a signal for a linear predictive filter and its driving sound source signal (sound source signal). One of the typical methods is CELP (Code Excited Linear Prediction). CELP obtains a synthesized speech signal (reconstructed signal) by driving a linear prediction filter having a linear prediction coefficient representing the frequency characteristics of input speech by an excitation signal given by the sum of a pitch signal representing the pitch period of speech and a sound source signal made up of a random number and a pulse. CELP is described in M. Schroeder et al., "Code-excited linear prediction: High-quality speech at very low bit rates," Proc. of IEEE Int. Conf. on Acoust., Speech and Signal Processing, pp. 937-940, 1985 (reference 1).

Mobile communications such as portable phones require high speech communication quality in noise environments represented by a crowded street of a city and a driving automobile. Speech coding based on the above-mentioned CELP suffers deterioration in the quality of speech (background noise speech) on which noise is superposed. To improve the encoding quality of background noise speech, the gain of a sound source signal is smoothed in the decoder.

A method of smoothing the gain of a sound source signal is described in "Digital Cellular Telecommunication System; Adaptive Multi-Rate Speech Transcoding," ETSI Technical Report, GSM 06.90 version 2.0.0, January 1999 (reference 2).

FIG. 4 shows an example of a conventional speech signal decoding apparatus for improving the coding quality of background noise speech by smoothing the gain of a sound source signal. A bit stream is input at a period (frame) of $T_{fr}$ msec (e.g., 20 msec), and a reconstructed vector is calculated at a period (subframe) of $T_{fr}/N_{sfr}$ msec (e.g., 5 msec) for an integer $N_{sfr}$(e.g., 4). The frame length is given by $L_{fr}$ samples (e.g., 320 samples), and the subframe length is given by $L_{sfr}$ samples (e.g., 80 samples). These numbers of samples are determined by the sampling frequency (e.g., 16 kHz) of an input signal. Each block will be described.

The code of a bit stream is input from an input terminal 10. A code input circuit 1010 segments the code of the bit stream input from the input terminal 10 into several segments, and converts them into indices corresponding to a plurality of decoding parameters. The code input circuit 1010 outputs an index corresponding to LSP (Linear Spectrum Pair) representing the frequency characteristics of the input signal to an LSP decoding circuit 1020. The circuit 1010 outputs an index corresponding to a delay $L_{pd}$ representing the pitch period of the input signal to a pitch signal decoding circuit 1210, and an index corresponding to a sound source vector made up of a random number and a pulse to a sound source signal decoding circuit 1110. The circuit 1010 outputs an index corresponding to the first gain to a first gain decoding circuit 1220, and an index corresponding to the second gain to a second gain decoding circuit 1120.

The LSP decoding circuit 1020 has a table which stores a plurality of sets of LSPs. The LSP decoding circuit 1020 receives the index output from the code input circuit 1010, reads an LSP corresponding to the index from the table, and sets the LSP as $LSP_{qj}^{(N_{sfr})}(n)$, $j=1,\Lambda,N_p$ in the $N_{sfr}$ th subframe of the current frame (nth frame). $N_p$ is a linear prediction order. The LSPs of the first to $(N_{sfr}-1)$th subframes are obtained by linearly interpolating $\hat{q}_j^{(N_{sfr})}(n)$ and $\hat{q}_j^{(N_{sfr})}(n-1)$. $LSP\hat{q}_j^{(m)}(n)$, $j=1,\Lambda,N_p$, $m=1,\Lambda,N_{sfr}$ are output to a linear prediction coefficient conversion circuit 1030 and smoothing coefficient calculation circuit 1310.

The linear prediction coefficient conversion circuit 1030 receives $LSP\hat{q}_j^{(m)}(n)$, $j=1,\Lambda,N_p$, $m=1,\Lambda,N_{sfr}$ output from the LSP decoding circuit 1020. The linear prediction coefficient conversion circuit 1030 converts the received $\hat{q}_j^{(m)}(n)$ into a linear prediction coefficient $\hat{\alpha}_j^{(m)}(n)$, $j=1,\Lambda,N_p$, $m=1,\Lambda,N_{sfr}$, and outputs $\hat{\alpha}_j^{(m)}(n)$ to a synthesis filter 1040. Conversion of the LSP into the linear prediction coefficient can adopt a known method, e.g., a method described in Section 5.2.4 of reference 2.

The sound source signal decoding circuit 1110 has a table which stores a plurality of sound source vectors. The sound source signal decoding circuit 1110 receives the index output from the code input circuit 1010, reads a sound source vector corresponding to the index from the table, and outputs the vector to a second gain circuit 1130.

The second gain decoding circuit 1120 has a table which stores a plurality of gains. The second gain decoding circuit 1120 receives the index output from the code input circuit 1010, reads a second gain corresponding to the index from the table, and outputs the second gain to a smoothing circuit 1320.

The second gain circuit 1130 receives the first sound source vector output from the sound source signal decoding circuit 1110 and the second gain output from the smoothing circuit 1320, multiplies the first sound source vector and the second gain to decode a second sound source vector, and outputs the decoded second sound source vector to an adder 1050.

A storage circuit 1240 receives and holds an excitation vector from the adder 1050. The storage circuit 1240 outputs an excitation vector which was input and has been held to the pitch signal decoding circuit 1210.

The pitch signal decoding circuit 1210 receives the past excitation vector held by the storage circuit 1240 and the index output from the code input circuit 1010. The index designates the delay $L_{pd}$. The pitch signal decoding circuit 1210 extracts a vector for $L_{sfr}$ samples corresponding to the vector length from the start point of the current frame to a past point by $L_{pd}$ samples in the past excitation vector. Then, the circuit 1210 decodes a first pitch signal (vector). For $L_{pd}<L_{sfr}$, the circuit 1210 extracts a vector for $L_{pd}$ samples, and repetitively couples the extracted $L_{pd}$ samples to decode the first pitch vector having a vector length of $L_{sfr}$ samples. The pitch signal decoding circuit 1210 outputs the first pitch vector to a first gain circuit 1230.

The first gain decoding circuit 1220 has a table which stores a plurality of gains. The first gain decoding circuit 1220 receives the index output from the code input circuit 1010, reads a first gain corresponding to the index, and outputs the first gain to the first gain circuit 1230.

The first gain circuit 1230 receives the first pitch vector output from the pitch signal decoding circuit 1210 and the first gain output from the first gain decoding circuit 1220, multiplies the first pitch vector and the first gain to generate a second pitch vector, and outputs the generated second pitch vector to the adder 1050.

The adder 1050 receives the second pitch vector output from the first gain circuit 1230 and the second sound source vector output from the second gain circuit 1130, adds them, and outputs the sum as an excitation vector to the synthesis filter 1040.

The smoothing coefficient calculation circuit 1310 receives $LSP\hat{q}_j^{(m)}(n)$ output from the LSP decoding circuit 1020, and calculates an average $LSP\bar{q}_{0j}(n)$:

$$\bar{q}_{0j}(n)=0.84\cdot\bar{q}_{0j}(n-1)+0.16\cdot\hat{q}_j^{(N_{sfr})}(n)$$

The smoothing coefficient calculation circuit 1310 calculates an LSP variation amount $d_0(m)$ for each subframe m:

$$d_0(m)=\sum_{j=1}^{N_p}\frac{|\bar{q}_{0j}(n)-\hat{q}_j^{(m)}(n)|}{\bar{q}_{0j}(n)}$$

The smoothing coefficient calculation circuit 1310 calculates a smoothing coefficient $k_0(m)$ of the subframe m:

$$k_0(m)=\min(0.25,\max(\theta,d_0(m)-0.4))/0.25$$

where min(x,y) is a function using a smaller one of x and y, and max(x,y) is a function using a larger one of x and y. The smoothing coefficient calculation circuit 1310 outputs the smoothing coefficient $k_0(m)$ to the smoothing circuit 1320.

The smoothing circuit 1320 receives the smoothing coefficient $k_0(m)$ output from the smoothing coefficient calculation circuit 1310 and the second gain output from the second gain decoding circuit 1120. The smoothing circuit 1320 calculates an average gain $\bar{g}_0(m)$ from a second gain $\hat{g}_0(m)$ of the subframe m by $$\bar{g}_0(m)=\frac{1}{5}\sum_{i=0}^{4}\hat{g}_0(m-i)$$

The second gain $\hat{g}_0(m)$ is replaced by $$\hat{g}_0(m)=\hat{g}_0(m)\cdot k_0(m)+\bar{g}_0(m)\cdot(1-k_0(m))$$

The smoothing circuit 1320 outputs the second gain $\hat{g}_0(m)$ to the second gain circuit 1130.

The synthesis filter 1040 receives the excitation vector output from the adder 1050 and a linear prediction coefficient $\alpha_i$, $i=1,\Lambda,N_p$ output from the linear prediction coefficient conversion circuit 1030. The synthesis filter 1040 calculates a reconstructed vector by driving the synthesis filter 1/A(z) in which the linear prediction coefficient is set, by the excitation vector. Then, the synthesis filter 1040 outputs the reconstructed vector from an output terminal 20. Letting $\alpha_i$, $i=1,\Lambda,N_p$ be the linear prediction coefficient, the transfer function 1/A(z) of the synthesis filter is given by $$\frac{1}{(A)z}=\frac{1}{\left(1-\sum_{i=1}^{N_p}\alpha_i z^i\right)}$$

FIG. 5 shows the arrangement of a speech signal encoding apparatus in a conventional speech signal encoding/decoding apparatus. A first gain circuit 1230, second gain circuit 1130, adder 1050, and storage circuit 1240 are the same as the blocks described in the conventional speech signal decoding apparatus in FIG. 4, and a description thereof will be omitted.

An input signal (input vector) generated by sampling a speech signal and combining a plurality of samples as one frame into one vector is input from an input terminal 30. A linear prediction coefficient calculation circuit 5510 receives the input vector from the input terminal 30. The linear prediction coefficient calculation circuit 5510 performs linear prediction analysis for the input vector to obtain a linear prediction coefficient. Linear prediction analysis is described in Chapter 8 "Linear Predictive Coding of Speech" of reference 4.

The linear prediction coefficient calculation circuit 5510 outputs the linear prediction coefficient to an LSP conversion/quantization circuit 5520.

The LSP conversion/quantization circuit 5520 receives the linear prediction coefficient output from the linear prediction coefficient calculation circuit 5510, converts the linear prediction coefficient into LSP, and quantizes the LSP to attain the quantized LSP. Conversion of the linear prediction coefficient into the LSP can adopt a known method, e.g., a method described in Section 5.2.4 of reference 2.

Quantization of the LSP can adopt a method described in Section 5.2.5 of reference 2. As described in the LSP decoding circuit of FIG. 4 (prior art), the quantized LSP is the quantized $LSP\hat{q}_j^{(N_{sfr})}(n)$, $j=1,\Lambda,N_p$ in the $N_{sfr}$ subframe of the current frame (nth frame). The quantized LSPs of the first to $(N_{sfr}-1)$th subframes are obtained by linearly interpolating $\hat{q}_j^{(N_{sfr})}(n)$ and $\hat{q}_j^{(N_{sfr})}(n-1)$. The LSP is $LSPq_j^{(N_{sfr})}(n)$, $j=1,\Lambda,N_p$ in the $N_{sfr}$ subframe of the current frame (nth frame). The LSPs of the first to $(N_{sfr}-1)$th subframes are obtained by linearly interpolating $q_j^{(N_{sfr})}(n)$ and $q_j^{(N_{sfr})}(n-1)$.

The LSP conversion/quantization circuit 5520 outputs the $LSPq_j^{(m)}(n)$, $j=1,\Lambda,N_p$, $m=1,\Lambda,N_{sfr}$, and the quantized LSP $\hat{q}_j^{(m)}(n)$, $j=1,\Lambda,N_p$, $m=1,\Lambda,N_{sfr}$ to a linear prediction coefficient conversion circuit 5030, and an index corresponding to the quantized $LSP\hat{q}_j^{(N_{sfr})}(n)$, $j=1,\Lambda,N_p$ to a code output circuit 6010.

The linear prediction coefficient conversion circuit 5030 receives the $LSPq_j^{(m)}(n)$, $j=1,\Lambda,N_p$, $m=1,\Lambda,N_{sfr}$, and the quantized $LSP\hat{q}_j^{(m)}(n)$, $j=1,\Lambda,N_p$, $m=1,\Lambda,N_{sfr}$ output from the LSP conversion/quantization circuit 5520. The circuit 5030 converts $q_j^{(m)}(n)$ into a linear prediction coefficient $\alpha_j^{(m)}(n)$, $j=1,\Lambda,N_p$, $m=1,\Lambda,N_{sfr}$, and $\hat{q}_j^{(m)}(n)$ into a quantized linear prediction coefficient $\hat{\alpha}_j^{(m)}(n)$, $j=1,\Lambda,N_p$, $m=1,\Lambda,N_{sfr}$. The linear prediction coefficient conversion circuit 5030 outputs the $\alpha_j^{(m)}(n)$ to the weighting filter 5050 and weighting synthesis filter 5040, and $\hat{\alpha}_j^{(m)}(n)$ to the weighting synthesis filter 5040. Conversion of the LSP into the linear prediction coefficient and conversion of the quantized LSP into the quantized linear prediction coefficient can adopt a known method, e.g., a method described in Section 5.2.4 of reference 2.

The weighting filter 5050 receives the input vector from the input terminal 30 and the linear prediction coefficient output from the linear prediction coefficient conversion circuit 5030, and generates a weighting filter W(z) corresponding to the human sense of hearing using the linear prediction coefficient. The weighting filter is driven by the input vector to obtain a weighted input vector. The weighting filter 5050 outputs the weighted input vector to a subtractor 5060. The transfer function W(z) of the weighting filter 5050 is given by $W(z)=Q(z/\gamma_1)/Q(z/\gamma_2)$. Note that $$Q\left(\frac{z}{\gamma_1}\right) = 1 - \sum_{i=1}^{N_p} \alpha_i^{(m)} \gamma_1^i z^i \text{ and}$$

$$Q\left(\frac{z}{\gamma_2}\right) = 1 - \sum_{i=1}^{N_p} \alpha_i^{(m)} \gamma_2^i z^i$$

where $\gamma_1$ and $\gamma_2$ are constants, e.g., $\gamma_1=0.9$ and $\gamma_2=0.6$. Details of the weighting filter are described in reference 1.

The weighting synthesis filter 5040 receives the excitation vector output from the adder 1050, and the linear prediction coefficient $\alpha_j^{(m)}(n)$, $j=1,\Lambda,N_p$, $m=1,\Lambda,N_{sfr}$, and the quantized linear prediction coefficient $\hat{\alpha}_j^{(m)}(n)$, $j=1,\Lambda,N_p$, $m=1,\Lambda,N_{sfr}$ that are output from the linear prediction coefficient conversion circuit 5030. A weighting synthesis filter $H(z)W(z)=Q(z/\gamma_1)/[A(z)Q(z/\gamma_2)]$ having $\alpha_j^{(m)}(n)$ and $\hat{\alpha}_j^{(m)}(n)$ is driven by the excitation vector to obtain a weighted reconstructed vector. The transfer function $H(z)=1/A(z)$ of the synthesis filter is given by $$\frac{1}{A(z)} = \frac{1}{\left(1 - \sum_{i=1}^{N_p} \hat{\alpha}_i^{(m)} z^i\right)}.$$

The subtractor 5060 receives the weighted input vector output from the weighting filter 5050 and the weighted reconstructed vector output from the weighting synthesis filter 5040, calculates their difference, and outputs it as a difference vector to a minimizing circuit 5070.

The minimizing circuit 5070 sequentially outputs all indices corresponding to sound source vectors stored in a sound source signal generation circuit 5110 to the sound source signal generation circuit 5110. The minimizing circuit 5070 sequentially outputs indices corresponding to all delays $L_{pd}$ within a range defined by a pitch signal generation circuit 5210 to the pitch signal generation circuit 5210. The minimizing circuit 5070 sequentially outputs indices corresponding to all first gains stored in a first gain generation circuit 6220 to the first gain generation circuit 6220, and indices corresponding to all second gains stored in a second gain generation circuit 6120 to the second gain generation circuit 6120.

The minimizing circuit 5070 sequentially receives difference vectors output from the subtractor 5060, calculates their norms, selects a sound source vector, delay $L_{pd}$, and first and second gains that minimize the norm, and outputs corresponding indices to the code output circuit 6010. The pitch signal generation circuit 5210, sound source signal generation circuit 5110, first gain generation circuit 6220, and second gain generation circuit 6120 sequentially receive indices output from the minimizing circuit 5070.

The pitch signal generation circuit 5210, sound source signal generation circuit 5110, first gain generation circuit 6220, and second gain generation circuit 6120 are the same as the pitch signal decoding circuit 1210, sound source signal decoding circuit 1110, first gain decoding circuit 1220, and second gain decoding circuit 1120 in FIG. 4 except for input/output connections, and a detailed description of these blocks will be omitted.

The code output circuit 6010 receives an index corresponding to the quantized LSP output from the LSP conversion/quantization circuit 5520, and indices corresponding to the sound source vector, delay $L_{pd}$, and first and second gains that are output from the minimizing circuit 5070. The code output circuit 6010 converts these indices into a bit stream code, and outputs it via an output terminal 40.

The first problem is that sound different from normal voiced speech is generated in short unvoiced speech intermittently contained in the voiced speech or part of the voiced speech. As a result, discontinuous sound is generated in the voiced speech. This is because the LSP variation amount $d_0(m)$ decreases in the short unvoiced speech to increase the smoothing coefficient. Since $d_0(m)$ greatly varies over time, $d_0(m)$ exhibits a large value to a certain degree in part of the voiced speech, but the smoothing coefficient does not become 0.

The second problem is that the smoothing coefficient abruptly changes in unvoiced speech. As a result, discontinuous sound is generated in the unvoiced speech. This is because the smoothing coefficient is determined using $d_0(m)$ which greatly varies over time.

The third problem is that proper smoothing processing corresponding to the type of background noise cannot be selected. As a result, the decoding quality degrades. This is because the decoding parameter is smoothed based on a single algorithm using only different set parameters.

SUMMARY OF THE INVENTION

It is an object of the present invention to provide a speech signal decoding method and apparatus for improving the quality of reconstructed speech against background noise speech.

To achieve the above object, according to the present invention, there is provided a speech signal decoding method comprising the steps of decoding information containing at least a sound source signal, a gain, and filter coefficients from a received bit stream, identifying voiced speech and unvoiced speech of a speech signal using the decoded information, performing smoothing processing based on the decoded information for at least either one of the decoded gain and the decoded filter coefficients in the unvoiced speech, and decoding the speech signal by driving a filter having the decoded filter coefficients by an excitation signal obtained by multiplying the decoded sound source signal by the decoded gain using a result of the smoothing processing.

DESCRIPTION OF THE PREFERRED EMBODIMENTS

The present invention will be described in detail below with reference to the accompanying drawings.

Figure 1:
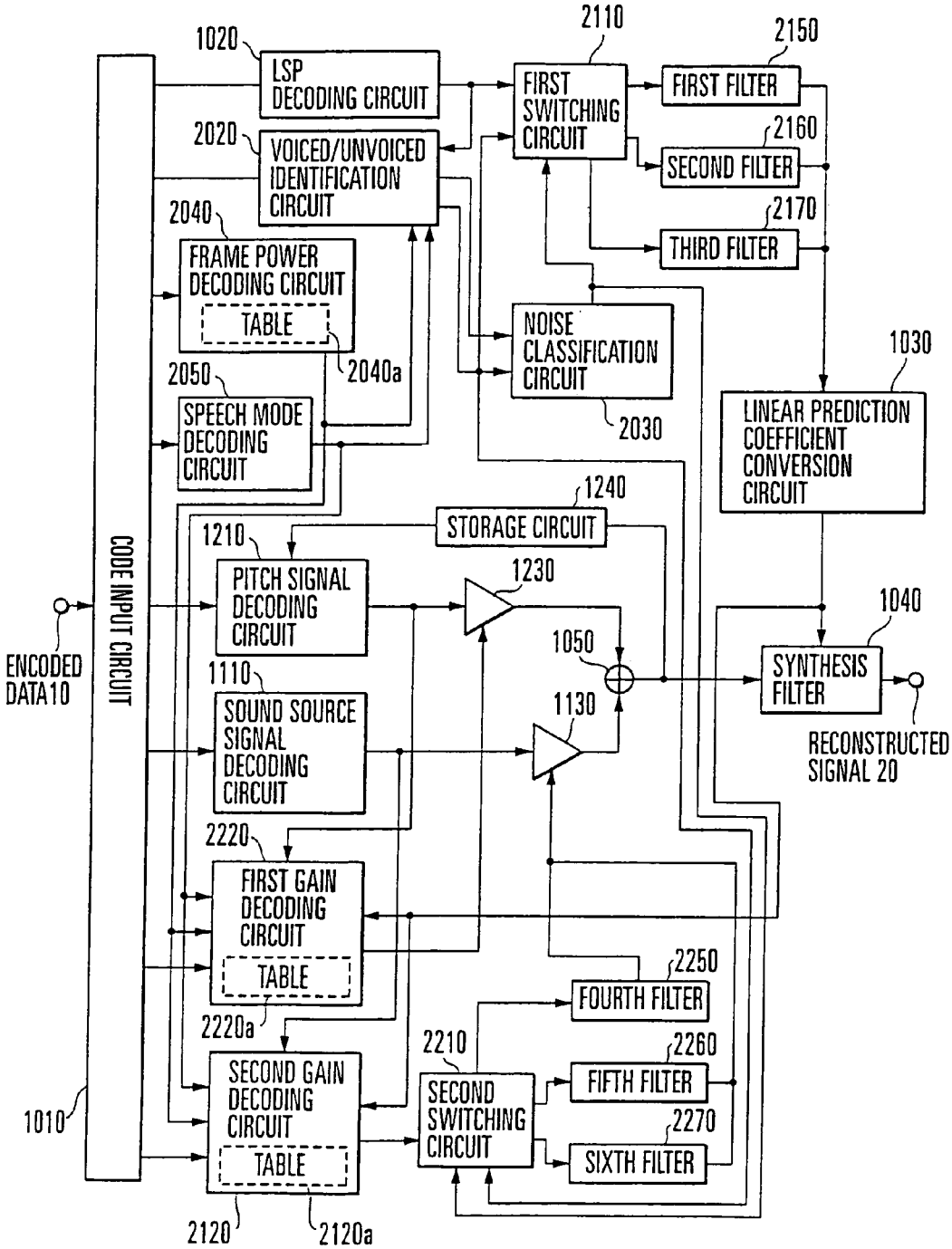
FIG. 1 is a block diagram showing a speech signal decoding apparatus according to the first embodiment of the present invention.

FIG. 1 shows a speech signal decoding apparatus according to the first embodiment of the present invention. An input terminal 10, output terminal 20, LSP decoding circuit 1020, linear prediction coefficient conversion circuit 1030, sound source signal decoding circuit 1110, storage circuit 1240, pitch signal decoding circuit 1210, first gain circuit 1230, second gain circuit 1130, adder 1050, and synthesis filter 1040 are the same as the blocks described in the prior art of FIG. 4, and a description thereof will be omitted.

A code input circuit 1010, voiced/unvoiced identification circuit 2020, noise classification circuit 2030, first switching circuit 2110, second switching circuit 2210, first filter 2150, second filter 2160, third filter 2170, fourth filter 2250, fifth filter 2260, sixth filter 2270, first gain decoding circuit 2220, and second gain decoding circuit 2120 will be described.

A bit stream is input at a period (frame) of $T_{fr}$ msec (e.g., 20 msec), and a reconstructed vector is calculated at a period (subframe) of $T_{fr}/N_{sfr}$ msec (e.g., 5 msec) for an integer $N_{sfr}$ (e.g., 4). The frame length is given by $L_{fr}$ samples (e.g., 320 samples), and the subframe length is given by $L_{sfr}$ samples (e.g., 80 samples). These numbers of samples are determined by the sampling frequency (e.g., 16 kHz) of an input signal. Each block will be described.

The code input circuit 1010 segments the code of a bit stream input from an input terminal 10 into several segments, and converts them into indices corresponding to a plurality of decoding parameters. The code input circuit 1010 outputs an index corresponding to LSP to the LSP decoding circuit 1020. The circuit 1010 outputs an index corresponding to a speech mode to a speech mode decoding circuit 2050, an index corresponding to a frame energy to a frame power decoding circuit 2040, an index corresponding to a delay $L_{pd}$ to the pitch signal decoding circuit 1210, and an index corresponding to a sound source vector to the sound source signal decoding circuit 1110. The circuit 1010 outputs an index corresponding to the first gain to the first gain decoding circuit 2220, and an index corresponding to the second gain to the second gain decoding circuit 2120.

The speech mode decoding circuit 2050 receives the index corresponding to the speech mode that is output from the code input circuit 1010, and sets a speech mode $S_{mode}$ corresponding to the index. The speech mode is determined by threshold processing for an intra-frame average $\overline{G}_{op}(n)$ of an open-loop pitch prediction gain $G_{op}(m)$ calculated using a perceptually weighted input signal in a speech encoder. The speech mode is transmitted to the decoder. In this case, n represents the frame number; and m, the subframe number. Determination of the speech mode is described in K. Ozawa et al., "M-LCELP Speech Coding at 4 kb/s with Multi-Mode and Multi-Codebook," IEICE Trans. On Commun., Vol. E77-B, No. 9, pp. 1114-1121, September 1994 (reference 3).

The speech mode decoding circuit 2050 outputs the speech mode $S_{mode}$ to the voiced/unvoiced identification circuit 2020, first gain decoding circuit 2220, and second gain decoding circuit 2120.

The frame power decoding circuit 2040 has a table 2040*a* which stores a plurality of frame energies. The frame power decoding circuit 2040 receives the index corresponding to the frame power that is output from the code input circuit 1010, and reads a frame power $\hat{E}_{rms}$ corresponding to the index from the table 2040*a*. The frame power is attained by quantizing the power of an input signal in the speech encoder, and an index corresponding to the quantized value is transmitted to the decoder. The frame power decoding circuit 2040 outputs the frame power $\hat{E}_{rms}$ to the voiced/unvoiced identification circuit 2020, first gain decoding circuit 2220, and second gain decoding circuit 2120.

The voiced/unvoiced identification circuit 2020 receives $LSP\hat{q}_j^{(m)}(n)$ output from the LSP decoding circuit 1020, the speech mode $S_{mode}$ output from the speech mode decoding circuit 2050, and the frame power $\hat{E}_{rms}$ output from the frame power decoding circuit 2040. The sequence of obtaining the variation amount of a spectral parameter will be explained.

As the spectral parameter, $LSP\hat{q}_j^{(m)}(n)$ is used. In the nth frame, a long-term average $\overline{q}_j(n)$ of the LSP is calculated by $$\overline{q}_j(n)=\beta_0\cdot\overline{q}_j(n-1)+(1\beta_0)\cdot\hat{q}_j^{(N_{sfr})}(n), j=1,\Lambda,N_p$$

where $\beta_0=0.9$.

A variation amount $d_q(n)$ of the LSP in the nth frame is defined by $$d_q(n)=\sum_{j=1}^{N_p}\sum_{m=1}^{N_{sfr}}\frac{D_{q,j}^{(m)}(n)}{\overline{q}_j(n)}$$

where $D_{qj}^{(m)}(n)$ corresponds to the distance between $\overline{q}_j(n)$ and $\hat{q}_j^{(m)}(n)$. For example, $$D_{qj}^{(m)}(n)=(\overline{q}_j(n)-\hat{q}_j^{(m)}(n))^2$$

or $$D_{qj}^{(m)}(n)=|\overline{q}_j(n)-\hat{q}_j^{(m)}(n)|$$

In this case, $D_{qj}^{(m)}(n)=|\overline{q}_j(n)-\hat{q}_j^{(m)}(n)|$ is employed.

A section where the variation amount $d_q(n)$ is large substantially corresponds to voiced speech, whereas a section where the variation amount $d_q(n)$ is small substantially corresponds to unvoiced speech. However, the variation amount $d_q(n)$ greatly varies over time, and the range of $d_q(n)$ in voiced speech and that in unvoiced speech overlap each other. Thus, a threshold for identifying voiced speech and unvoiced speech is difficult to set.

For this reason, the long-term average of $d_q(n)$ is used to identify voiced speech and unvoiced speech. A long-term average $\overline{d}_{q1}(n)$ of $d_q(n)$ is calculated using a linear or nonlinear filter. As $\overline{d}_{q1}(n)$, the average, median, or mode of $d_q(n)$ can be applied. In this case, $$\overline{d}_{q1}(n)=\beta_1\cdot\overline{d}_{q1}(n-1)+(1-\beta_1)\cdot d_q(n)$$

is used where $\beta_1=0.9$.

Threshold processing for $\overline{d}_{q1}(n)$ determines an identification flag $S_{vs}$:

$$\text{if } (\overline{d}_{q1}(n)\geqq C_{th1}) \text{ then } S_{vs}=1$$

$$\text{else } S_{vs}=0$$

where $C_{th1}$ is a given constant (e.g., 2.2), $S_{vs}=1$ corresponds to voiced speech, and $S_{vs}=0$ corresponds to unvoiced speech.

Even voiced speech may be mistaken for unvoiced speech in a section where steadiness is high because $d_q(n)$ is small. To avoid this, a section where the frame power and pitch prediction gain are large is regarded as voiced speech. For $S_{vs}=0$, $S_{vs}$ is corrected by the following additional determination:

$$\text{if } (\hat{E}_{rms}\geqq C_{rms} \text{ and } S_{mode}\geqq 2) \text{ then } S_{vs}=1$$

else $S_{vs}=0$ where $C_{rms}$ is a given constant (e.g., 10,000), and $S_{mode} \geqq 2$ corresponds to an intra-frame average $\overline{G}_{op}(n)$ of 3.5 dB or more for the pitch prediction gain.

This is defined by the encoder.

The voiced/unvoiced identification circuit 2020 outputs $S_{vs}$ to the noise classification circuit 2030, first switching circuit 2110, and second switching circuit 2210, and $\overline{d}_{q1}(n)$ to the noise classification circuit 2030.

The noise classification circuit 2030 receives $\overline{d}_{q1}(n)$ and $S_{vs}$ that are output from the voiced/unvoiced identification circuit 2020. In unvoiced speech (noise), a value $\overline{d}_{q2}(n)$ which reflects the average behavior of $\overline{d}_{q1}(n)$ is obtained using a linear or non-linear filter.

For $S_{vs}=0$, $$\overline{d}_{q2}(n)=\beta_2\cdot\overline{d}_{q2}(n-1)+(1-\beta_2)\cdot\overline{d}_{q1}(n)$$

is calculated for $\beta 2=0.94$.

Threshold processing for $\overline{d}_{q2}(n)$ classifies noise to determine a classification flag $S_{nz}$:

if $(\overline{d}_{q2}(n) \geqq C_{th2})$ then $S_{nz}=1$ else $S_{nz}=0$ where $C_{th2}$ is a given constant (e.g., 1.7), $S_{nz}=1$ corresponds to noise whose frequency characteristics unsteadily change over time, and $S_{nz}=0$ corresponds to noise whose frequency characteristics steadily change over time. The noise classification circuit 2030 outputs $S_{nz}$ to the first and second switching circuits 2110 and 2210.

The first switching circuit 2110 receives $LSP\hat{q}_j^{(m)}(n)$ output from the LSP decoding circuit 1020, the identification flag $S_{vs}$ output from the voiced/unvoiced identification circuit 2020, and the classification flag $S_{nz}$ output from the noise classification circuit 2030. The first switching circuit 2110 is switched in accordance with the identification and classification flag values to output $LSP\hat{q}_j^{(m)}(n)$ to the first filter 2150 for $S_{vs}=0$ and $S_{nz}=0$, to the second filter 2160 for $S_{vs}=0$ and $S_{nz}=1$, and to the third filter 2170 for $S_{vs}=1$.

The first filter 2150 receives $LSP\hat{q}_j^{(m)}(n)$ output from the first switching circuit 2110, smoothes it using a linear or non-linear filter, and outputs it as a first smoothed LsP $\overline{q}_{1,j}^{(m)}(n)$ to the linear prediction coefficient conversion circuit 1030. In this case, the first filter 2150 uses a filter given by $$\overline{q}_{1,j}^{(m)}(n)=\gamma_1\cdot\overline{q}_{1,j}^{(m-1)}(n)+(1-\gamma_1)\cdot\hat{q}_j^{(m)}(n), j=1,\Lambda,N_p$$

where $\overline{q}_{1,j}^{(0)}(n)=\overline{q}_{1,j}^{(N_{sfr})}(n-1)$, and $\gamma_1=0.5$.

The second filter 2160 receives $LSP\hat{q}_j^{(m)}(n)$ output from the first switching circuit 2110, smoothes it using a linear or non-linear filter, and outputs it as a second smoothed LSP $\overline{q}_{2,j}^{(m)}(n)$ to the linear prediction coefficient conversion circuit 1030. In this case, the second filter 2160 uses a filter given by $$\overline{q}_{2,j}^{(m)}(n)=\gamma_2\cdot\overline{q}_{2,j}^{(m-1)}(n)+(1=\gamma_2)\cdot\hat{q}_j^{(m)}(n), j=1,\Lambda,N_p$$

where $\overline{q}_{2,j}^{(0)}(n)=\overline{q}_{2,j}^{(N_{sfr})}(n-1)$, and $\gamma_1=0.0$.

The third filter 2170 receives $LSP\hat{q}_j^{(m)}(n)$ output from the first switching circuit 2110, smoothes it using a linear or non-linear filter, and outputs it as a third smoothed LSP $\overline{q}_{3,j}^{(m)}(n)$ to the linear prediction coefficient conversion circuit 1030. In this case, $\overline{q}_{3,j}^{(m)}(n)=\hat{q}_j^{(m)}(n)$.

The second switching circuit 2210 receives the second gain $\hat{g}_1^{(m)}(n)$ output from the second gain decoding circuit 2120, the identification flag $S_{vs}$ output from the voiced/unvoiced identification circuit 2020, and the classification flag $S_{nz}$ output from the noise classification circuit 2030. The second switching circuit 2210 is switched in accordance with the identification and classification flag values to output the second gain $\hat{g}_2^{(m)}(n)$ to the fourth filter 2250 for $S_{vs}=0$ and $S_{nz}=0$, to the fifth filter 2260 for $S_{vs}=0$ and $S_{nz}=1$, and to the sixth filter 2270 for $S_{vs}=1$.

The fourth filter 2250 receives the second gain $\hat{g}_2^{(m)}(n)$ output from the second switching circuit 2210, smoothes it using a linear or non-linear filter, and outputs it as a first smoothed gain $\overline{g}_{2,1}^{(m)}(n)$ to the second gain circuit 1130. In this case, the fourth filter 2250 uses a filter given by $$\overline{g}_{2,1}^{(m)}(n)=\gamma_2\cdot\overline{g}_{2,1}^{(m-1)}(n)+(1=\gamma_2)\cdot\hat{g}_2^{(m)}(n)$$

where $\overline{g}_{2,1}^{(0)}(n)=\overline{q}_{2,1}^{(N_{sfr})}(n-1)$, and $\gamma_1=0.9$.

The fifth filter 2260 receives the second gain $\hat{g}_2^{(m)}(n)$ output from the second switching circuit 2210, smoothes it using a linear or non-linear filter, and outputs it as a second smoothed gain $\overline{g}_{2,2}^{(m)}(n)$ to the second gain circuit 1130. In this case, the fifth filter 2260 uses a filter given by $$\overline{g}_{2,2}^{(m)}(n)=\gamma_2\cdot\overline{g}_{2,2}^{(m-1)}(n)+(1=\gamma_2)\cdot\hat{g}_2^{(m)}(n)$$

where $\overline{g}_{2,2}^{(0)}(n)=\overline{q}_{2,2}^{(N_{sfr})}(n-1)$, and $\gamma_1=0.9$.

The sixth filter 2270 receives the second gain $\hat{g}_2^{(m)}(n)$ output from the second switching circuit 2210, smoothes it using a linear or non-linear filter, and outputs it as a third smoothed gain $\overline{g}_{2,3}^{(m)}(n)$ to the second gain circuit 1130. In this case, $\overline{g}_{2,3}^{(m)}(n)=\hat{g}_2^{(m)}(n)$.

The first gain decoding circuit 2220 has a table **2220*a* which stores a plurality of gains. The first gain decoding circuit 2220 receives an index corresponding to the third gain output from the code input circuit 1010, the speech mode $S_{mode}$ output from the speech mode decoding circuit 2050, the frame power $\hat{E}_{rms}$ output from the frame power decoding circuit 2040, the linear prediction coefficient $\hat{\alpha}_j^{(m)}(n)$, $j=1,\Lambda,N_p$ of the mth subframe of the nth frame output from the linear prediction coefficient conversion circuit 1030, and a pitch vector $c_{ac}(i)$, $i=1,\Lambda,L_{sfr}$ output from the pitch signal decoding circuit 1210**.

The first gain decoding circuit 2220 calculates a k parameter $k_j^{(m)}(n)$, $j=1,\Lambda,N_p$ (to be simply represented as $k_j$) from the linear prediction coefficient $\hat{\alpha}_j^{(m)}(n)$. This is calculated by a known method, e.g., a method described in Section 8.3.2 in L. R. Rabiner et al., "Digital Processing of Speech Signals," Prentice-Hall, 1978 (reference 4). Then, the first gain decoding circuit 2220 calculates an estimated residual power $\tilde{E}_{res}$ using $k_j$:

$$\tilde{E}_{res}=\hat{E}_{rms}\sqrt{\pi_{j=1}^{N_p}(1-k_j^2)}$$

The first gain decoding circuit 2220 reads a third gain $\hat{\gamma}_{gac}$ corresponding to the index from the table **2220*a*** switched by the speech mode $S_{mode}$, and calculates a first gain $\hat{g}_{ac}$:

$$\hat{g}_{ac}=\hat{\gamma}_{gac}\frac{\tilde{E}_{res}}{\sqrt{\sum_{i=0}^{L_{sfr}-1}c_{ac}^2(i)}}$$

The first gain decoding circuit 2220 outputs the first gain $\hat{g}_{ac}$ to the first gain circuit 1230. The second gain decoding circuit 2120 has a table **2120*a*** which stores a plurality of gains.

The second gain decoding circuit 2120 receives an index corresponding to the fourth gain output from the code input circuit 1010, the speech mode $S_{mode}$ output from the speech mode decoding circuit 2050, the frame power $\hat{E}_{rms}$ output from the frame power decoding circuit 2040, the linear prediction coefficient $\hat{\alpha}_j^{(m)}(n)$, $j=1,\Lambda,N_p$ of the mth subframe of the nth frame output from the linear prediction coefficient conversion circuit 1030, and a sound source vector $c_{ec}(i)$, $i=1,\Lambda,L_{sfr}$ output from the sound source signal decoding circuit 1110.

The second gain decoding circuit 2120 calculates a k parameter $k_j^{(m)}(n)$, $j=1,\Lambda,N_p$ (to be simply represented as $k_j$) from the linear prediction coefficient $\hat{\alpha}_j^{(m)}(n)$. This is calculated by the same known method as described for the first gain decoding circuit 2220. Then, the second gain decoding circuit 2120 calculates an estimated residual power $\tilde{E}_{res}$ using $k_j$:

$$\tilde{E}_{res}=\hat{E}_{rms}\sqrt{\pi_{j=1}^{N_p}(1-k_j^2)}$$

The second gain decoding circuit 2120 reads a fourth gain $\hat{\gamma}_{gec}$ corresponding to the index from the table 2120*a* switched by the speech mode $S_{mode}$, and calculates a second gain $\hat{g}_{ec}$:

$$\hat{g}_{ec}=\hat{\gamma}_{gec}\frac{\tilde{E}_{res}}{\sqrt{\sum_{i=0}^{L_{sfr}-1}c_{ec}^2(i)}}$$

The second gain decoding circuit 2120 outputs the second gain $\hat{g}_{ec}$ to the second switching circuit 2210.

Figure 2:
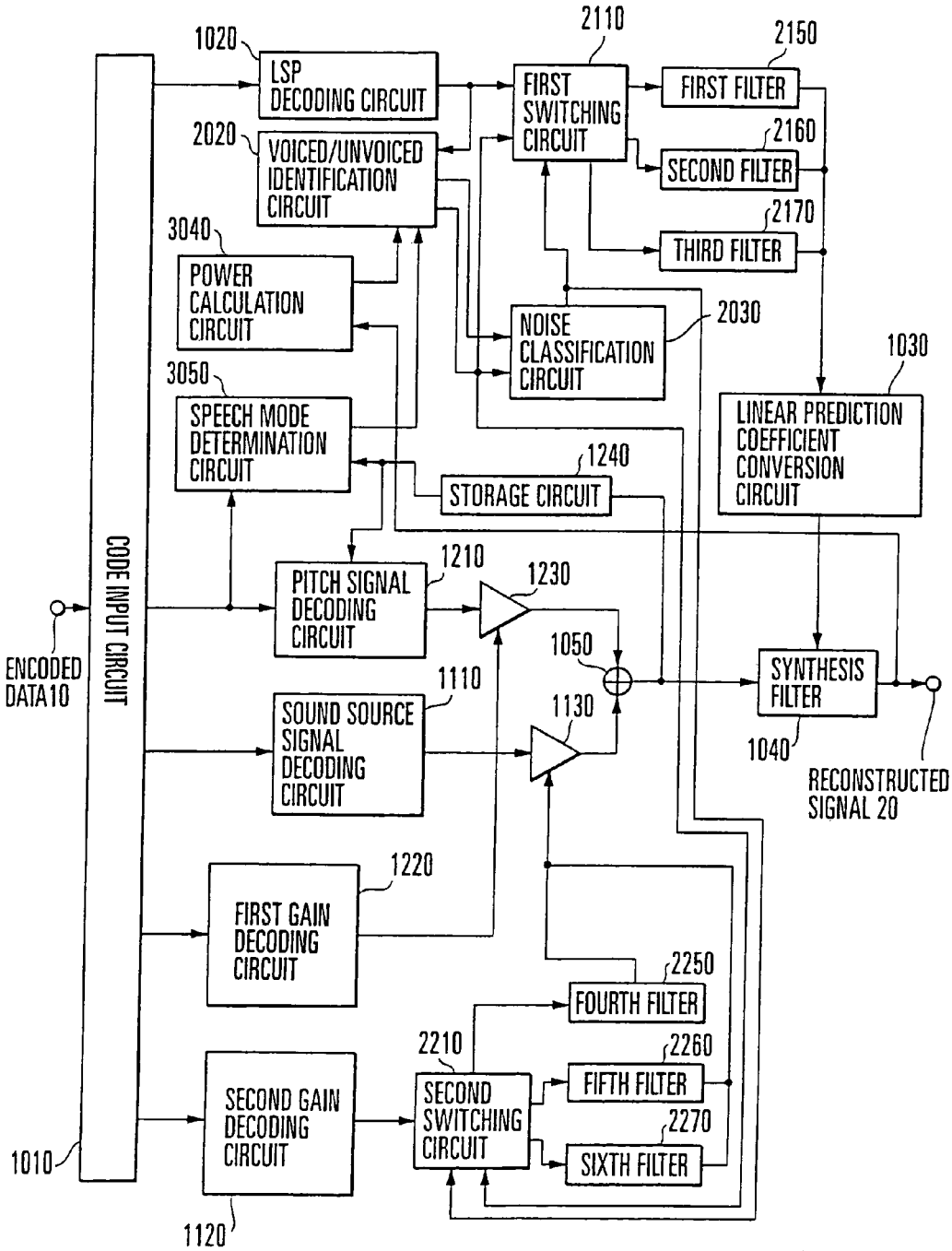
FIG. 2 is a block diagram showing a speech signal decoding apparatus according to the second embodiment of the present invention.

FIG. 2 shows a speech signal decoding apparatus according to the second embodiment of the present invention.

This speech signal decoding apparatus of the present invention is implemented by replacing the frame power decoding circuit 2040 in the first embodiment with a power calculation circuit 3040, the speech mode decoding circuit 2050 with a speech mode determination circuit 3050, the first gain decoding circuit 2220 with a first gain decoding circuit 1220, and the second gain decoding circuit 2120 with second gain decoding circuit 1120. In this arrangement, the frame power and speech mode are not encoded and transmitted in the encoder, and the frame power (power) and speech mode are obtained using parameters used in the decoder.

Figure 4:
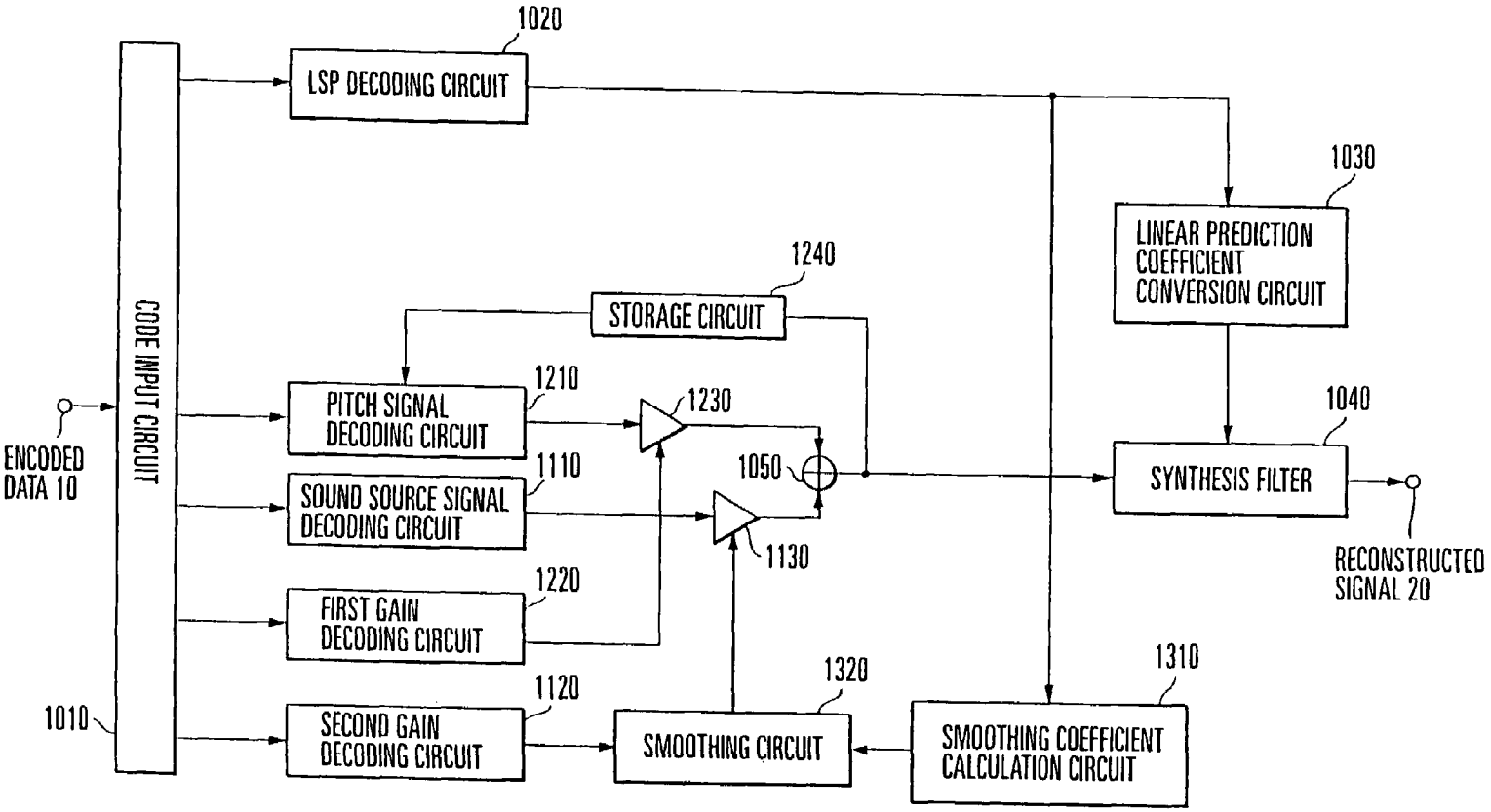
FIG. 4 PRIOR ART
FIG. 4 is a block diagram showing a conventional speech signal decoding apparatus.

The first and second gain decoding circuits 1220 and 1120 are the same as the blocks described in the prior art of FIG. 4, and a description thereof will be omitted.

The power calculation circuit 3040 receives a reconstructed vector output from a synthesis filter 1040, calculates a power from the sum of squares of the reconstructed vectors, and outputs the power to a voiced/unvoiced identification circuit 2020. In this case, the power is calculated for each subframe. Calculation of the power in the mth subframe uses a reconstructed signal output from the synthesis filter 1040 in the (m-1)th subframe. For a reconstructed signal $S_{syn}(i)$, $i=0,\Lambda,L_{sfr}$, the power $E_{rms}$ is calculated by, e.g., RMS (Root Mean Square):

$$E_{rms}=\sqrt{\sum_{i=0}^{L_{sfr}-1}s_{syn}^2(i)}$$

The speech mode determination circuit 3050 receives a past excitation vector $e_{mem}(i)$, $i=0,\Lambda,L_{mem}-1$ held by a storage circuit 1240, and the index output from the code input circuit 1010. The index designates a delay $L_{pd}$. $L_{mem}$ is a constant determined by the maximum value of $L_{pd}$.

In the mth subframe, a pitch prediction gain $G_{emem}(m)$, $m=1,\Lambda,N_{sfr}$ is calculated from the past excitation vector $e_{mem}(i)$ and delay $L_{pd}$:

$$G_{emem}(m)=10\cdot\log_{10}(g_{emem}(m))$$

where $$g_{emem}(m)=\frac{1}{1-\frac{E_c^2(m)}{E_{a1}(m)E_{a2}(m)}}$$

$$E_{a1}(m)=\sum_{i=0}^{L_{sfr}-1}e_{mem}^2(i)$$

$$E_{a2}(m)=\sum_{i=0}^{L_{sfr}-1}e_{mem}^2(i-L_{pd})$$

$$E_c(m)=\sum_{i=0}^{L_{sfr}-1}e_{mem}(i)e_{mem}(i-L_{pd})$$

The pitch prediction gain $G_{emem}(m)$ or the intra-frame average $\overline{G}_{emem}(n)$ in the nth frame of $G_{emem}(m)$ undergoes the following threshold processing to set a speech mode $S_{mode}$:

if $(\overline{G}_{emem}(n)\geqq 3.5)$ then $S_{mode}=2$ else $S_{mode}=0$

The speech mode determination circuit 3050 outputs the speech mode $S_{mode}$ to the voiced/unvoiced identification circuit 2020.

Figure 3:
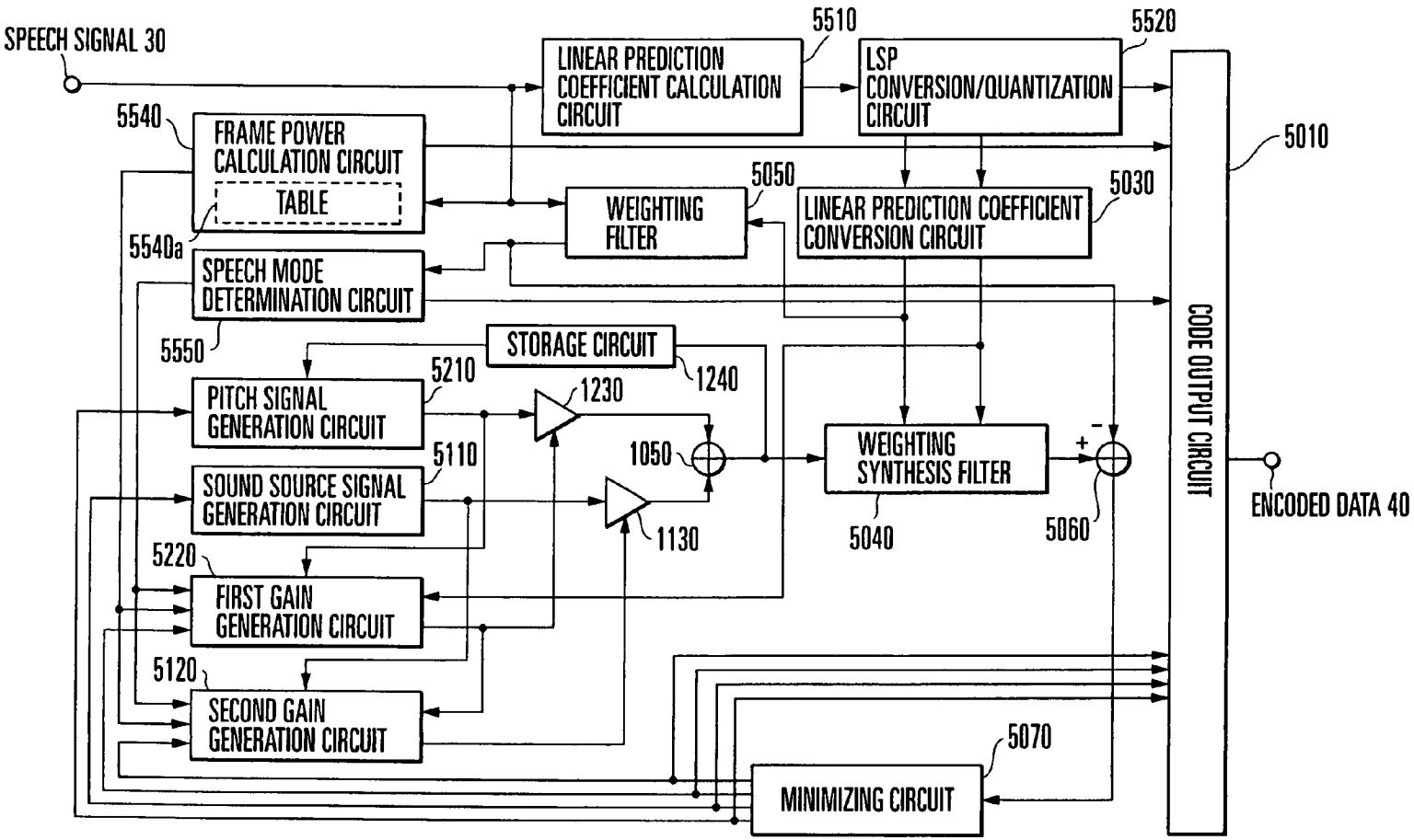
FIG. 3 is a block diagram showing a speech signal encoding apparatus used in the present invention.

FIG. 3 shows a speech signal encoding apparatus used in the present invention.

Figure 5:
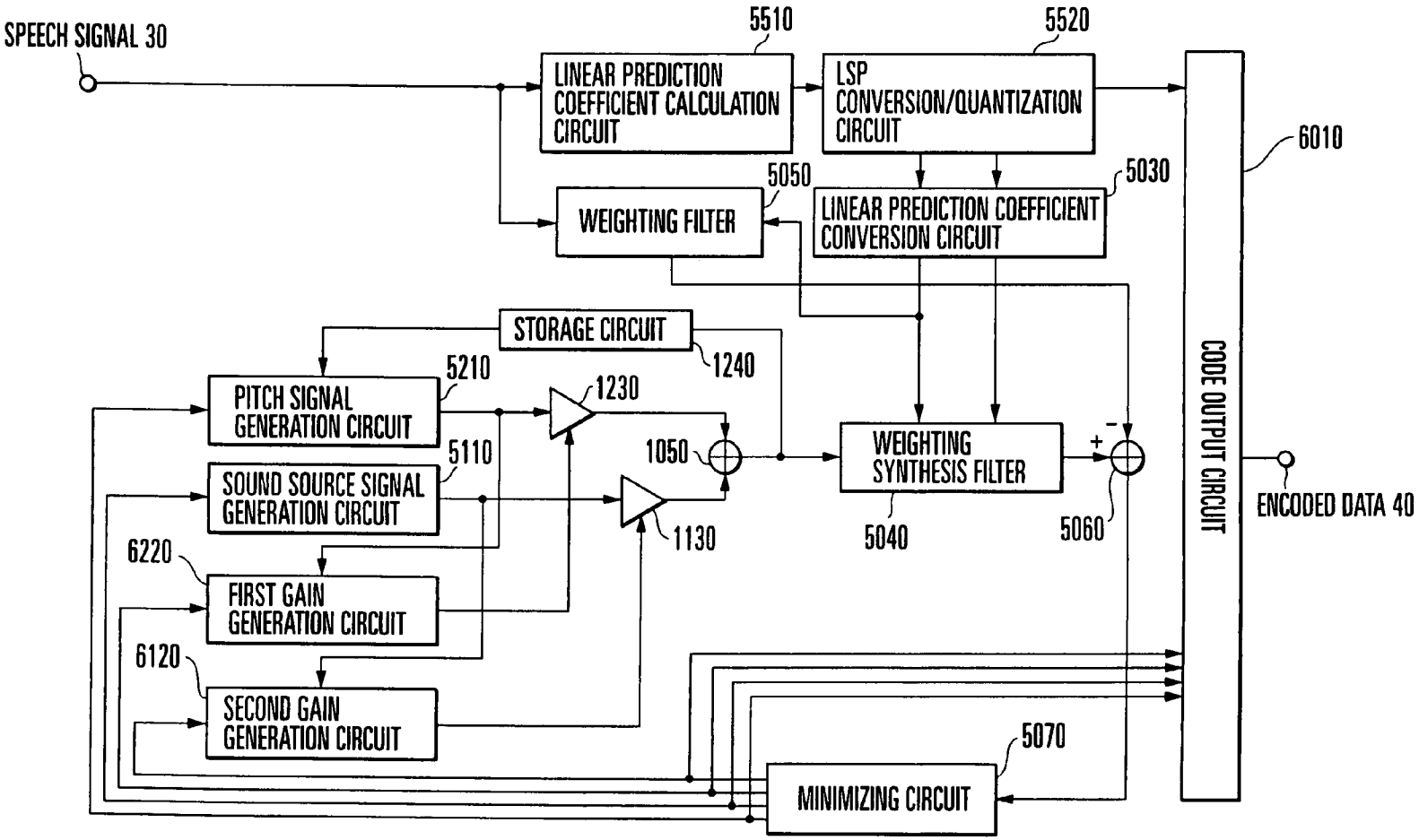
FIG. 5 PRIOR ART
FIG. 5 is a block diagram showing a conventional speech signal encoding apparatus.

The speech signal encoding apparatus in FIG. 3 is implemented by adding a frame power calculation circuit 5540 and speech mode determination circuit 5550 in the prior art of FIG. 5, replacing the first and second gain generation circuits 6220 and 6120 with first and second gain generation circuits 5220 and 5120, and replacing the code output circuit 6010 with a code output circuit 5010. The first and second gain generation circuits 5220 and 5120, an adder 1050, and a storage circuit 1240 are the same as the blocks described in the prior art of FIG. 5, and a description thereof will be omitted.

The frame power calculation circuit 5540 has a table 5540*a* which stores a plurality of frame energies. The frame power calculation circuit 5540 receives an input vector from an input terminal 30, calculates the RMS (Root Mean Square) of the input vector, and quantizes the RMS using the table to attain a quantized frame power $\hat{E}_{rms}$, For an input vector $s_i(i)$, $i=0,\Lambda,L_{sfr}$, a power $E_{irms}$ is given by $$E_{irms}=\sqrt{\sum_{i=0}^{L_{sfr}-1}s_i^2(i)}$$

The frame power calculation circuit 5540 outputs the quantized frame power $\hat{E}_{rms}$ to the first and second gain generation circuits 5220 and 5120, and an index corresponding to $\hat{E}_{rms}$ to the code output circuit 5010.

The speech mode determination circuit 5550 receives a weighted input vector output from a weighting filter 5050.

The speech mode $S_{mode}$ is determined by executing threshold processing for the intra-frame average $\overline{G}_{op}(n)$ of an open-loop pitch prediction gain $G_{op}(m)$ calculated using the weighted input vector. In this case, n represents the frame number; and m, the subframe number.

In the mth subframe, the following two equations are calculated from a weighted input vector $s_{wi}(i)$ and the delay $L_{tmp}$, and $L_{tmp}$ which maximizes $E_{sctmp}^2(m)/E_{sa2tmp}$ is obtained and set as $L_{op}$:

$$E_{sctmp}(m) = \sum_{i=0}^{L_{sfr}-1} s_{wi}(i)s_{wi}(i - L_{tmp})$$

$$E_{sa2tmp}(m) = \sum_{i=0}^{L_{sfr}-1} s_{wi}^2(i - L_{tmp})$$

From the weighted input vector $s_{wi}(i)$ and the delay $L_{op}$, the pitch prediction gain $G_{op}(m)$, $m=1,\Lambda,N_{sfr}$ is calculated:

$$G_{op}(m)=10\cdot\log_{10}(g_{op}(m))$$

where $$g_{op}(m) = \frac{1}{1 - \frac{E_{sc}^2(m)}{E_{sa1}(m)E_{sa2}(m)}}$$

$$E_{sa1}(m) = \sum_{i=0}^{L_{sfr}-1} s_{wi}^2(i)$$

$$E_{sa2}(m) = \sum_{i=0}^{L_{sfr}-1} s_{wi}^2(i - L_{op})$$

$$E_{sc}(m) = \sum_{i=0}^{L_{sfr}-1} s_{wi}(i)s_{wi}(i - L_{op})$$

The pitch prediction gain $G_{op}(m)$ or the intra-frame average $\overline{G}_{op}(n)$ in the nth frame of $G_{op}(m)$ undergoes the following threshold processing to set the speech mode $S_{mode}$:

if $(\overline{G}_{op}(n) \geqq 3.5)$ then $S_{mode}=2$ else $S_{mode}=0$

Determination of the speech mode is described in K. Ozawa et al., "M-LCELP Speech Coding at 4 kb/s with Multi-Mode and Multi-Codebook," IEICE Trans. On Commun., Vol. E77-B, No. 9, pp. 1114-1121, 1994 (reference 3).

The speech mode determination circuit 5550 outputs the speech mode $S_{mode}$ to the first and second gain generation circuits 5220 and 5120, and an index corresponding to the speech mode $S_{mode}$ to the code output circuit 5010.

A pitch signal generation circuit 5210, a sound source signal generation circuit 5110, and the first and second gain generation circuits 5220 and 5120 sequentially receive indices output from a minimizing circuit 5070. The pitch signal generation circuit 5210, sound source signal generation circuit 5110, first gain generation circuit 5220, and second gain generation circuit 5120 are the same as the pitch signal decoding circuit 1210, sound source signal decoding circuit 1110, first gain decoding circuit 2220, and second gain decoding circuit 2120 in FIG. 1 except for input/output connections, and a detailed description of these blocks will be omitted.

The code output circuit 5010 receives an index corresponding to the quantized LSP output from the LSP conversion/quantization circuit 5520, an index corresponding to the quantized frame power output from the frame power calculation circuit 5540, an index corresponding to the speech mode output from the speech mode determination circuit 5550, and indices corresponding to the sound source vector, delay $L_{pd}$, and first and second gains that are output from the minimizing circuit 5070. The code output circuit 5010 converts these indices into a bit stream code, and outputs it via an output terminal 40.

The arrangement of a speech signal encoding apparatus in a speech signal encoding/decoding apparatus according to the fourth embodiment of the present invention is the same as that of the speech signal encoding apparatus in the conventional speech signal encoding/decoding apparatus, and a description thereof will be omitted.

In the above-described embodiments, the long-term average of $d_0(m)$ varies over time more gradually than $d_0(m)$, and does not intermittently decrease in voiced speech. If the smoothing coefficient is determined in accordance with this average, discontinuous sound generated in short unvoiced speech intermittently contained in voiced speech can be reduced. By performing identification of voiced or unvoiced speech using the average, the smoothing coefficient of the decoding parameter can be completely set to 0 in voiced speech.

Also for unvoiced speech, using the long-term average of $d_0(m)$ can prevent the smoothing coefficient from abruptly changing.

The present invention smoothes the decoding parameter in unvoiced speech not by using single processing, but by selectively using a plurality of processing methods prepared in consideration of the characteristics of an input signal. These methods include moving average processing of calculating the decoding parameter from past decoding parameters within a limited section, auto-regressive processing capable of considering long-term past influence, and non-linear processing of limiting a preset value by an upper or lower limit after average calculation.

According to the first effect of the present invention, sound different from normal voiced speech that is generated in short unvoiced speech intermittently contained in voiced speech or part of the voiced speech can be reduced to reduce discontinuous sound in the voiced speech. This is because the long-term average of $d_0(m)$ which hardly varies over time is used in the short unvoiced speech, and because voiced speech and unvoiced speech are identified and the smoothing coefficient is set to 0 in the voiced speech.

According to the second effect of the present invention, abrupt changes in smoothing coefficient in unvoiced speech are reduced to reduce discontinuous sound in the unvoiced speech. This is because the smoothing coefficient is determined using the long-term average of $d_0(m)$ which hardly varies over time.

According to the third effect of the present invention, smoothing processing can be selected in accordance with the type of background noise to improve the decoding quality. This is because the decoding parameter is smoothed selectively using a plurality of processing methods in accordance with the characteristics of an input signal.

What is claimed is:

1. A speech signal decoding apparatus comprising:

a plurality of decoding means for decoding information containing at least a sound source signal, a gain, and filter coefficients from a received bit stream;

smoothing means for obtaining a modified decoded information by modifying the decoded information of a current frame using the modified decoded information obtained at a previous frame to perform smoothing processing for at least either one of the decoded gain and the decoded filter coefficients contained in the decoded information;

means for obtaining an excitation signal by multiplying the decoded sound source signal by the decoded gain after performing the smoothing processing; and means for decoding the speech signal by driving a filter having the decoded filter coefficients by the excitation signal obtained from the means for obtaining.

2. The apparatus as recited in claim 1, wherein said decoding means decodes information containing pitch periodicity and a power of the speech signal from the received bit stream.

3. The apparatus as recited in claim 1, further comprising:

identification means for identifying voiced speech and unvoiced speech of a speech signal using the decoded information, at least the unvoiced speech containing a background noise.

4. The apparatus as recited in claim 3, wherein said identification means performs identification operation using a value obtained by averaging for a long term a variation amount based on a difference between the decoded filter coefficients and their long-term average.

5. A speech signal decoding apparatus comprising:

a plurality of decoding units configured to decode information containing at least a sound source signal, a gain, and filter coefficients from a received bit stream;

a smoothing unit configured to smooth a modified decoded information by modifying the decoded information of a current frame using the modified decoded information obtained at a previous frame to perform smoothing processing for at least either one of the decoded gain and the decoded filter coefficients contained in the decoded information;

an obtaining unit configured to obtain an excitation signal by multiplying the decoded sound source signal by the decoded gain after performing the smoothing processing; and a decoding unit configured to decode the speech signal by driving a filter having the decoded filter coefficients by the excitation signal obtained from the obtaining unit.

6. The apparatus as recited in claim 5, wherein said decoding unit decodes information containing pitch periodicity and a power of the speech signal from the received bit stream.

7. The apparatus as recited in claim 5, further comprising:

an identification unit configured to identify identifying voiced speech and unvoiced speech of a speech signal using the decoded information, at least the unvoiced speech containing a background noise.

8. The apparatus as recited in claim 7, wherein said identification unit performs identification operation using a value obtained by averaging for a long term a variation amount based on a difference between the decoded filter coefficients and their long-term average.

9. A speech signal method comprising:

decoding information containing at least a sound source signal, a gain, and filter coefficients from a received bit stream;

obtaining a modified decoded information by modifying the decoded information of a current frame using the modified decoded information obtained at a previous frame and performing smoothing processing for at least either one of the decoded gain and the decoded filter coefficients contained in the decoded information;

obtaining an excitation signal by multiplying the decoded sound source signal by the decoded gain after performing the smoothing processing; and decoding the speech signal by driving a filter having the decoded filter coefficients by the excitation signal obtained from the obtaining step.

10. The method as recited in claim 9, wherein said decoding step comprises:

decoding information containing pitch periodicity and a power of the speech signal from the received bit stream.

11. The method as recited in claim 9, further comprising:

identifying voiced speech and unvoiced speech of a speech signal using the decoded information, at least the unvoiced speech containing a background noise.

12. The method as recited in claim 11, wherein said identification step comprises:

performing an identification operation using a value obtained by averaging for a long term a variation amount based on a difference between the decoded filter coefficients and their long-term average.

* * * * *